US005558142A

United States Patent [19]

Ehrle et al.

[11] Patent Number: 5,558,142

[45] Date of Patent: Sep. 24, 1996

[54] WOODWORKING MILLING CUTTER PARTICULARLY FOR GROOVING AND PROFILING

[75] Inventors: Bruno Ehrle, Neuhausen; Rolf Herzog, Winterthur, both of Switzerland; Andreas Mosmann, Wutöschingen-Horheim, Germany; Reto Riedberger, Hochfelden; Alfred Weber, Uhwiesen, both of Switzerland

[73] Assignee: Oertli Werkzeuge AG, Höri bei Bülach, Switzerland

[21] Appl. No.: 449,483

[22] Filed: May 24, 1995

[30] Foreign Application Priority Data

Jun. 20, 1994 [CH] Switzerland ..... 1941/94

[51] Int. Cl.[6] ..... B27G 13/00

[52] U.S. Cl. ..... 144/230; 144/218; 144/239; 144/241; 407/46; 407/49

[58] Field of Search ..... 144/218, 229, 144/230, 234, 236, 241; 407/5, 37–41, 46, 47, 49, 50, 93, 106, 113

[56] References Cited

U.S. PATENT DOCUMENTS

| | | | |
|---|---|---|---|
| 2,731,991 | 1/1956 | Cowley . | |
| 3,559,261 | 2/1971 | Greenleaf | 407/46 |
| 3,791,429 | 2/1974 | Morris | 407/46 |
| 3,838,724 | 10/1974 | Buchacher et al. | 144/230 |
| 4,449,556 | 5/1984 | Colton | 407/106 |
| 4,702,424 | 10/1987 | Widlak | 144/230 |
| 5,163,490 | 11/1992 | Meis | 144/230 |
| 5,209,278 | 5/1993 | Carpenter et al. | 144/230 |

FOREIGN PATENT DOCUMENTS

| | | |
|---|---|---|
| 1528208 | 12/1970 | Germany . |
| 2209236 | 11/1972 | Germany . |
| 8906720 U | 11/1990 | Germany . |
| 436678 | 11/1967 | Switzerland . |
| 2087792 | 6/1982 | United Kingdom . |

*Primary Examiner*—W. Donald Bray
*Attorney, Agent, or Firm*—Frishauf, Holtz, Goodman, Langer & Chick, P.C.

[57] ABSTRACT

To provide a reliable, yet resilient, seat for a cutter blade or knife (13) in a rotary milling body (11), the milling body is formed with a bore (21) which intersects the inner wall (19) of a recess (12) in the circumference of the milling body (11). A roll pin is inserted in the bore, retained therein, but projecting over the plane of the wall surface (19). The knife (13) is formed with a longitudinal groove (27), having opposite flat angled side walls (60), which fit around the projecting surface of the roll pin. A holding element (15), fitted into the recess, bears against knife and resiliently clamps it against the roll pin. Preferably, the holding element (15) and the knife (13) are formed with an interengaging projection (41) and recess (42) arrangement.

7 Claims, 2 Drawing Sheets

WOODWORKING MILLING CUTTER PARTICULARLY FOR GROOVING AND PROFILING

Reference to related patent, the disclosure of which is hereby incorporated by reference:

U.S. Pat. No. 2,731,991, Cowley.

Reference to related disclosure:

German Patent Publication DE-A-22 09 236;

German Utility Model DE-U-89 06 720.7.

FIELD OF THE INVENTION

The present invention relates to a milling cutter for woodworking, particularly to make grooves, cut profiles or, in general, for shaping or profiling wooden objects, in which a milling body has removable cutter blades or knives fitted in recesses of the body, and securely held therein by a holding body which, in turn, is clamped in the recess.

BACKGROUND

The referenced German Patent publication DE-A-22 09 236 describes a milling cutter in which a plurality of knives are retained in a body. The holder for the knives in the milling cutter body are retained on the base of recesses with a pin. The holding body has a plurality of teeth, extending parallel to the axis of rotation of the circular milling body, which teeth engage in corresponding groves formed in the knife, in order to secure the knife in the milling body. The grooves and teeth ensure that the cutting edge of the knife is precisely on the desired theoretical cutting circle of the milling cutter. The holding body is formed as a resilient element, and the clamping element is formed by a screw with a conical head which, when screwed into milling body, clamps the upper portion of the holding body against a knife. The knife is formed with a plurality of teeth at the side adjacent the wall of the milling body, which teeth are arranged at a right angle to the grooves at the front or forward side of the milling cutter. The rearwardly located teeth engage in grooves formed in the body of the milling cutter. The teeth and grooves of the holding body, of the cutter or knife, and the milling body permit positioning the knife in its appropriate location in the milling body, and holding it therein.

It has been found that this construction is comparatively complex and expensive in manufacture. The accuracy of the positioning is affected by tolerances in the attachment of the holding body, the teeth of the holding body, and the grooves in the knife, which is undesirable. Dirt, chips and wood dust, which may deposit between the teeth of the holding body and the grooves of the cutter blade or knife, or between the teeth of the cutter blade or knife and the grooves of the holding body, also interfere with accuracy in positioning of the cutter blade or knife.

THE INVENTION

It is an object to improve a milling cutter, particularly for woodworking, which is simple and inexpensive to manufacture, while permitting precise positioning of the knife, or its cutting edge, respectively, in relation to the milling cutter and the theoretical cutting circle of the milling cutter.

Briefly, the cutter blade is resiliently held in the milling cutter by forming a bore in the milling cutter which intersects a wall of a recess therein, and introducing a roll pin into the bore, against which the cutter blade can bear. Roll pins are, essentially, heavy patterned circumferentially springy dowel sleeves, which can be placed, under some tension, in the bore, but which can yield when subjected to circumferential compressive forces. In accordance with a feature of the invention, the knife is formed with a groove at the side with which it bears against the roll pin, so that the circumference of the roll pin is in springy engagement with the knife or the cutter blade.

The arrangement has the advantage that it is easily manufactured, simple, and permits comparatively inexpensive manufacture of the milling body. The milling body, in accordance with the prior art as described in the German Patent Disclosure Document DE-A-22 09 236, required expensive special arrangements to make the grooves to anchor the milling cutter or knife by deforming the milling cutter body with the grooves. In accordance with the present invention, it is only necessary to provide a bore adjacent the recesses, suitably dimensioned to receive the roll pin. This, also, permits simplification, with respect to the prior art, of the holding body for the knife and of the knife or cutter itself. It is no longer necessary to affix the holding body in the milling body by a pin.

The resilient roll pin, and the groove formed in the cutter or knife, ensure that the knife reliably engages against the wall of the recess formed in the milling body. The wall of the milling body is easily cleaned immediately before the knife is inserted, and special cleaning around grooves or ridges, as in the prior art, is no longer necessary. The clean seat of the cutter on the wall substantially improves precise positioning of the cutter or knife within.the milling body.

In accordance with a preferred feature of the invention, the longitudinal groove of the knife or cutter, which engages the roll pin, is formed with side walls arranged at an angle with respect to each other. This ensures a line-engagement of the knife or cutter with the circumferential surface of the roll pin. If, by mischance, tiny dust or other contaminating particles would be in the groove of the knife, the angled side walls of the groove will still maintain accuracy of positioning of the knife in the milling body.

Preferably, the axis of the roll pin is located in a plane perpendicular to the axis of rotation of the milling body. This results in a particularly simple construction. The clamping element for the holding body is, preferably, a screw which has two threads of respectively opposite pitch, or direction of rotation. One of the threads engages in a tapped hole in the milling body and the other in a tapped hole in the holding body. This arrangement ensures that when the screw is released, the holding body is lifted out of the recess and does not remain clamped therein.

Preferably, the holding element is formed with an interengaging projection-and-recess arrangement with respect to the knife. For example, the holding body is formed with a projection which engages in a recess or notch formed in the knife or cutter blade. This prevents the knife from falling out if frictional forces to hold it in place are insufficient. Additionally, the recess within the milling body can be formed with a locating abutment or stop corner for the knife to ensure precise positioning of the knife, or its cutter blade, respectively, with respect to the cutting diameter of the milling cutter as a whole. The positioning of the cutter blade or knife then merely depends on the tolerance of the position of the stop and of the engaging surface of the knife.

The end of the knife opposite the cutting edge can be rounded so that the engagement of the cutter blade or knife with the stop or locating abutment is essentially point-shaped or line-shaped. This also effectively prevents that any dirt or contaminating particles, which might deposit between the abutment and stop and the knife blade, interfere with accuracy of the positioning of the knife blade in the milling body.

DRAWING

DETAILED DESCRIPTION

Figure 1:
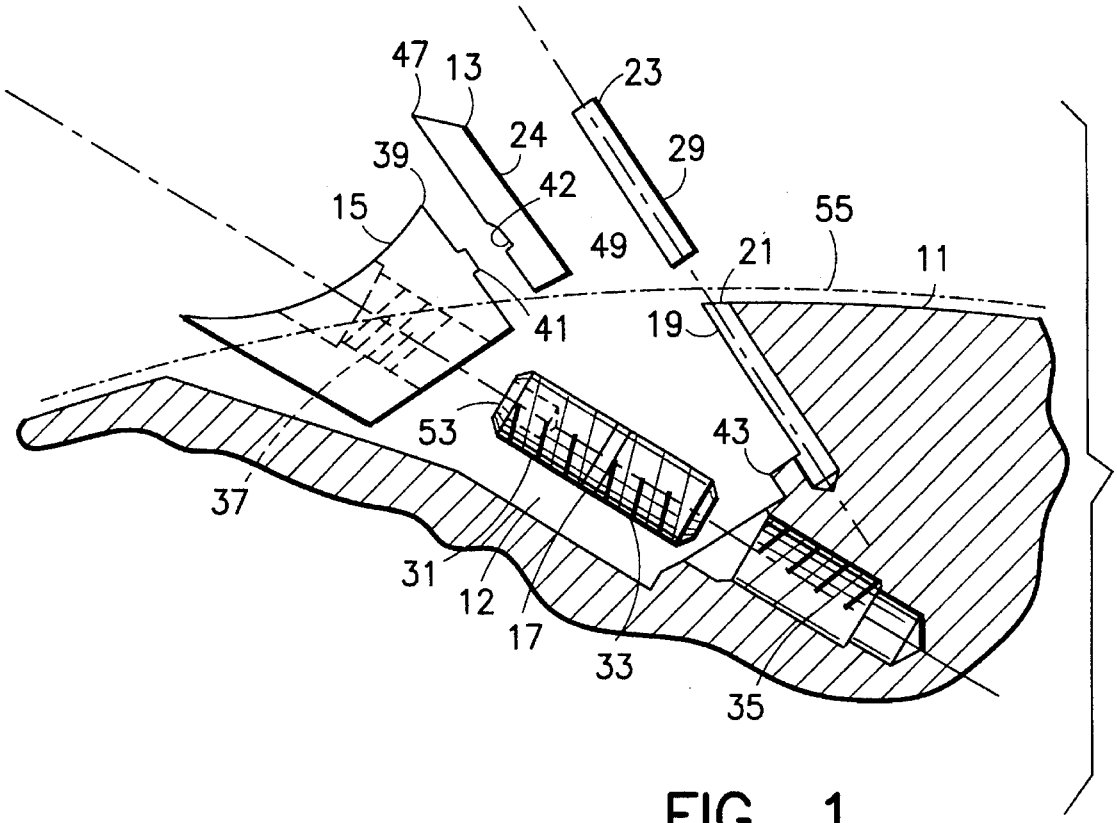
FIG. 1 is an exploded view of a portion of a milling body, which is shown in section, showing the roll pin and knife, as well as the holding body and holding screw removed from their operating position.
Figure 2:
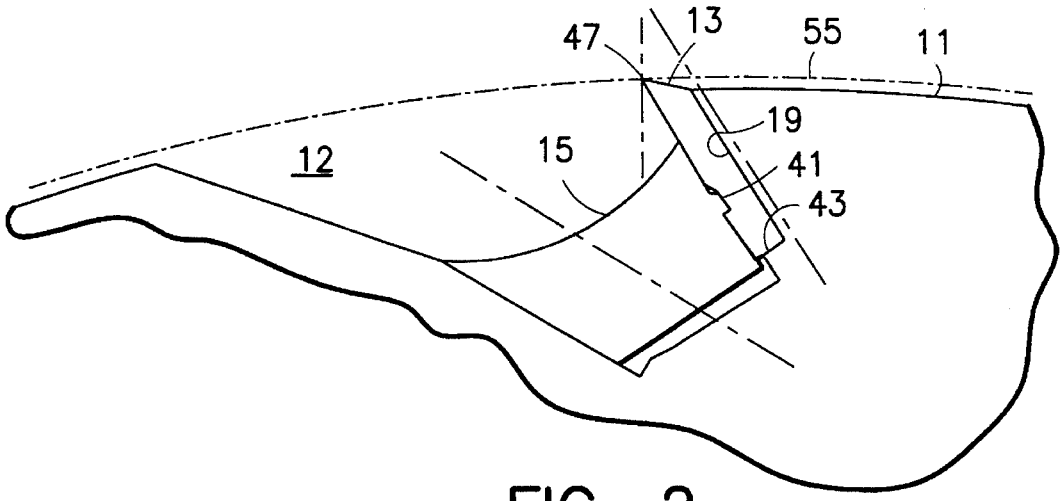
FIG. 2 is a view similar to FIG. 1, illustrating the cutter blade or knife clamped in position.
Figure 3:
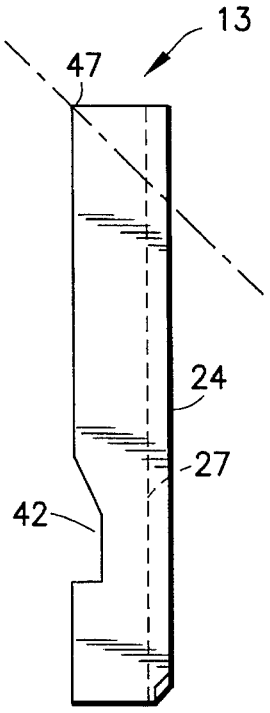
FIG. 3 is a side view of the blank for the knife.

Referring first to FIGS. 1 and 2:

The milling cutter, shown only in fragmentary representation, has a body 11, formed with at least one, and usually a plurality of recesses 12, to receive at least one, or a plurality of knives 13. A holding body 15 retains the respective knife 13 in the recess 12. The holding body 15 is retained in position by a screw 17.

In accordance with a feature of the invention, a bore 21 is formed in the body 11 adjacent the wall 19. The bore intersects the wall 19. The axis of the bore 21 is located within the body 11 at a distance more than half, but less than the entire diameter of the bore 19. The depth of intersection of the wall 19 with respect to the bore 21 is less than half the diameter of the bore. The bore 21, thus, looked at from the top would have a generally C configuration. A roll pin 23 is inserted in the bore 21.

Figure 4:
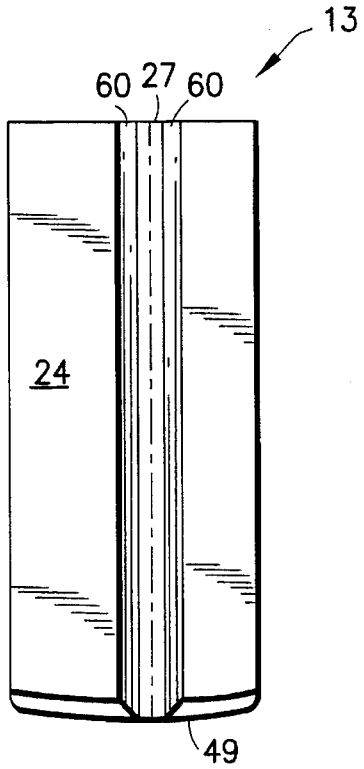
FIG. 4 is a front view of the knife of FIG. 3 looked at from the right of FIG. 3.
Figure 5:
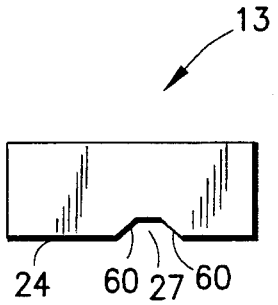
FIG. 5 is a top view of the knife of FIG. 4.
Figure 7:
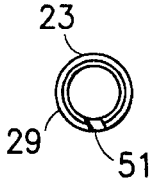
FIG. 7 is a top view of the roll pin of FIG. 6.

As best seen in FIGS. 4 and 5, knife 13 is formed with a groove 27 on the side 24 which engages the wall 19. The groove 27, when the knife is positioned in the body 11, engages the circumferential surface 29 of the roll pin 23 which is exposed outside of the wall 19 of the recess 12. This, since the roll pin is resilient, is a springy or resilient engagement.

The groove 27 of the knife 13 has side walls 60 (FIG. 5) which are angled with respect to each other. The angle is not critical. A suitable angle is, for example, about 45° with respect to the side 24 of the knife, or about 90° between walls 60.

Screw 17, which clamps the holding body 15 of the knife, is formed with two threads 31 and 33, which have, respectively, opposite directions of pitch. Thus, for example and preferably, thread 33 is a right-hand thread and thread 31 a left-hand thread. The thread 33 engages in a preferably right-hand tapped bore 35 formed in a milling body 11. Thread 31 engages in a tapped hole 37 formed in the holding body 15.

The holding body 15 and the knife are formed with an interengaging arrangement which, in its simplest form, is a projection 41 extending from the holding body 15 which fits into a notch 42 formed in the knife. The recess 12 is formed with a stop 43, for example in shape of a shoulder (see FIG. 1) to provide an abutment for the knife or cutter blade 13. As best seen in FIG. 4, the end surface 49 of the knife or cutter blade is rounded, so that the engagement of the surface 49 with the abutment 43 will be essentially point or line-shaped.

Figure 6:
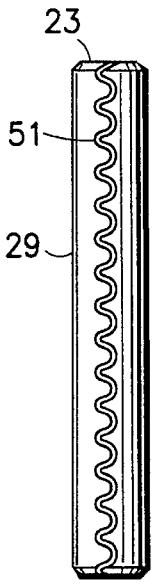
FIG. 6 is a side view of a commercial roll pin.

The roll pin 23 is a commercial article of manufacture, having standardized dimensions (for example Standard VSM 12786 of the Association of Swiss Machine Manufacturers). The roll pin 23 is in the shape of a sleeve or tube, formed with a generally longitudinally extending slit 51. In a preferred and commercial embodiment, the slit is undulated, as seen in FIG. 6.

Positioning of knife, and assembly:

To introduce the knife 13, screw 17, which has at its outer end a recess to receive an Allen head, or Torx wrench, is screwed into the respective tapped bores 37 and 35 of the holding element 15 and of the body 11. The roll pin 23 laterally positions the knife or cutter blade 13. The abutment or stop 43 precisely positions the knife with respect to the cutting diameter 55. After tightening, the knife 13 engages the wall 19 of the recess 12, and the roll pin 23 resiliently engages the side walls 60 of the groove 27 of the knife 13.

To assemble the knife 13 in the rotary body 11, the roll pin 23 is mounted in the body 11. Accordingly, when the knife 13 has to be inserted, the cutter is preferably brought into a position where the wall 19 is approximately horizontal. Thus the knife 13 can be put on the surface 19 without the danger of falling out of recess 12. Now the screw 17 is engaged, preferably a little bit, into the holder part 15. The assembly of 17 and 15 can then be brought into position, and when the screw 17 is turned in the normal manner, it screws into the thread 35 and at the same time into the thread 37. The projection 41 will engage the recess 42.

We claim:

1. Woodworking milling cutter, particularly for grooving and profiling, having a tool body (11) forming a body of rotation;

at least one cutting blade (13);

at least one circumferential recess (12) formed in the tool body defining one wall (19), the at least one cutting blade being positioned against said wall;

at least one holding element (15) located in the at least one recess, and engaging the at least one cutter blade (13) for retaining the cutter blade in the recess;

clamping means (17) securing the holding element in the recess; and means for resiliently engaging the at least one cutter blade against said wall (19) of the respective recess, said engagement means comprising at least one bore (21) formed in the body (11) extending parallel to said wall (19) of the recess, a portion of which bore intersects the wall of the recess to leave said portion exposed in the recess (12);

a roll pin (23) located in the bore (21) and having a portion of its surface exposed in the recess (12); and a groove formed in the cutter blade at the side facing said wall (19) of the recess (12) and in resilient engagement with a portion of the roll pin (23), which portion of the roll pin (23) is exposed in the surface of the wall (19) of the recess.

2. The milling cutter of claim 1, wherein said groove (27) formed in the cutter blade (13) has two side walls (27), each side wall defining an angle facing the other with respect to a surface of the knife (13) in which the groove is formed.

3. The milling cutter of claim 1, wherein the at least one recess (12) includes a stop shoulder (43) to provide an engagement abutment for the at least one cutting blade (13).

4. The milling cutter of claim 3, wherein the axis of the roll pin (23) is located in a plane which is essentially perpendicular to said stop abutment.

5. The milling cutter of claim 3, wherein the at least one cutting blade (13) is formed with an end surface opposite a cutting edge thereof, which end surface is rounded transversely to the cutting blade to provide for essentially point or line-shaped engagement with the abutment stopper (43).

6. The milling cutter of claim 1, wherein the clamping means for the holding element (15) comprises a screw (17) having two oppositely pitched threads (31, 33);

the tool body (11) is formed with a tapped hole (35) receiving one (33) of said threads; and wherein the holding element (15) is formed with a tapped holding element bore (37) receiving the other (31) of said threads.

7. The milling cutter of claim 1, further including interengaging projection-and-recess means (41, 42) formed, respectively, on the at least one holding element (15) and the at least one cutting blade (13) for interengagement with each other.

* * * * *